US006578474B1

(12) United States Patent
Sasaki

(10) Patent No.: US 6,578,474 B1
(45) Date of Patent: Jun. 17, 2003

(54) PRINTING OR COATING METHOD AND PRINTING OR COATING DEVICE

(75) Inventor: Takashi Sasaki, Tokyo (JP)

(73) Assignee: Surfcoat Co., Ltd., Tokyo (JP)

( * ) Notice: Subject to any disclaimer, the term of this patent is extended or adjusted under 35 U.S.C. 154(b) by 0 days.

(21) Appl. No.: 09/600,552

(22) PCT Filed: Nov. 25, 1999

(86) PCT No.: PCT/JP99/06556

§ 371 (c)(1),
(2), (4) Date: Sep. 7, 2000

(87) PCT Pub. No.: WO00/30766

PCT Pub. Date: Jun. 2, 2000

(30) Foreign Application Priority Data

Nov. 25, 1998 (JP) ..... 10-334307
Nov. 12, 1999 (JP) ..... 11-323376
Nov. 25, 1999 (JP) ..... 11-333573

(51) Int. Cl.[7] ..... B41F 17/00; B41B 1/00; H05B 1/00; B41J 5/30

(52) U.S. Cl. ..... 101/35; 101/399; 101/488; 123/142.5; 219/200; 219/201; 219/202; 219/203; 219/204; 400/61

(58) Field of Search ..... 101/488, 399, 101/35; 400/61; 219/200–204; 123/142.5

(56) References Cited

U.S. PATENT DOCUMENTS 2,935,933 A 5/1960 Moeller ..... 101/44
3,715,762 A * 2/1973 Magill et al. ..... 346/74
3,861,940 A * 1/1975 Forgo et al. ..... 117/17.5
5,670,261 A 9/1997 Kameya et al. ..... 428/457
6,135,654 A * 10/2000 Jennel ..... 400/61
6,145,331 A * 11/2000 Tuhro ..... 62/186
6,164,848 A * 12/2000 Coufal ..... 400/76
6,257,136 B1 * 7/2001 McCoy et al. ..... 101/38.1
6,286,421 B1 * 9/2001 Ackley ..... 101/38.1

FOREIGN PATENT DOCUMENTS

| | | |
|---|---|---|
| JP | 51-22939 | 7/1976 |
| JP | 58-3678 | 1/1983 |
| JP | 3-9792 | 1/1991 |
| JP | 4-22834 | 2/1992 |
| JP | 7-28358 | 1/1995 |
| JP | 8-57147 | 3/1996 |
| JP | 2512044 | 7/1996 |
| JP | 8-315956 | 11/1996 |
| JP | 8-332434 | 12/1996 |
| JP | 9-38529 | 2/1997 |

* cited by examiner

*Primary Examiner*—Daniel J. Colilla
*Assistant Examiner*—Marvin P Crenshaw
(74) *Attorney, Agent, or Firm*—Oliff & Berridge, PLC

(57) ABSTRACT

A work surface is subjected to a corona discharge treatment and then to printing or coating. A container surface is subjected to a corona discharge treatment and preheating and then to printing or coating. The printed or coated container is heated to dry the ink or coating material and the filled materials in the container are also heat-treated. The printing or coating used is of the non-spray type. The preheating device and heating device used are of the high frequency heating type. A direction change mechanism is provided to make it possible to apply printing or coating to one container at two or more places therein and to subject containers in general to preheating and a corona discharge treatment.

16 Claims, 7 Drawing Sheets

PRINTING OR COATING METHOD AND PRINTING OR COATING DEVICE

BACKGROUND OF THE INVENTION

1. Field of Invention

The present invention relates to a printing or coating device for automobile parts, in which printing or coating is automatically effected on automobile parts by using a printing machine.

2. Description of Related Art

Product names, part names, company names, company logo marks, decoration patterns or designs, or handling explanation characters are printed on surfaces of vehicle metallic parts such as pistons, piston rings, lifter valves and rocker arms of vehicle engines (particularly, sliding parts thereof), and metallic parts such as rotors used in car's air conditioners and motor cores, and panels and cases as electric parts, and various products or parts such as sports goods (for example, baseball bats and skiing plates), fishing rods, stationery, and containers such as cans and bottles and tablewares, or coating for protection, lubrication, buffer, dressing or anti-corrosion is applied to such surfaces. Particularly, the printing or coating is effected on the movable surfaces such as rotating or sliding portions of products or parts in order to improve a sliding property such as smooth sliding, noise elimination or anti-wear.

Work surfaces to be printed or coated include various surfaces such as a flat surface, spherical surface and curved surface, and works are formed from various materials such as resin, ceramics, glass, rubber, wood, bamboo, leather or stone. Existing screen printing machines, pad printing machines or roller type printing machines have been used for effecting the printing or coating on such work surfaces. The printing machine may be of unitary or independent type or may be of continuous type having various functions.

When the printing or coating is effected by using such a printing machine, it is required that the work be pre-heated in a heating furnace prior to the printing or coating or the printed ink or coated paint-be dried in a heating furnace after the printing or coating. In this case, many works must be arranged on a tray or plate orderly and then be inserted into the heating furnace, which is troublesome. Further, when mounting and dismounting with respect to the heating furnace, the works may be contacted with each other by vibration, with the result that the paint on the works may be peeled or the printed characters or patterns may become obscure due to rubbing before drying or the paint or the printed ink on the work may be transferred onto another work to contaminate the work. Furthermore, since the heating device or heating furnace must be installed in the vicinity of the printing machine, great installation space is required.

SUMMARY OF THE INVENTION

An object of the present invention is to provide a printing or coating method and a printing or coating device, in which pre-heating prior to printing or coating, and, heating and drying of ink or paint after the printing or coating can be performed in a continuous line automatically and efficiently, an efficient printing or coating operation can be effected for a short time, good printing or painting can be achieved, excessive or useless ink or paint is not consumed during the printing or coating operation, and the environment is not contaminated by volatile ink or paint, a printing or coating equipment can be made compact, and the above-mentioned conventional drawbacks can be eliminated.

According to a first aspect of the present invention, there is provided a printing or coating device for automobile parts in which an endless conveying device which conveys an automobile parts (a work), a preheating device which preheats a work surface conveyed by the endless conveying device by a high frequency heating, a printing or coating portion which prints or coats the preheated work surface conveyed by the conveying device and a heating device which heats and dried ink and paint by the high frequency heating after printing or coating are provided, said preheating device, said printing or coating portion and said heating device are disposed on a conveying line of said endless conveying device, said preheating device is disposed ahead of the printing or coating portion in a conveying direction and said heating device is disposed behind the printing or coating device in a conveying direction.

According to a second aspect of the present invention, there is provided a printing or coating device for automobile parts in which an endless conveying device which conveys an automobile component (a work), a preheating device which preheats a work surface conveyed by the endless conveying device by a high frequency heating, a printing or coating portion which prints or coats the preheated work surface conveyed by the conveying device, a heating device which heats and dries ink and paint by the high frequency heating after printing or coating and an orientation changing mechanism for changing orientation of a work with respect to a printing or coating portion are provided, said preheating device, said printing or coating portion and said heating device are disposed on a conveying line of said endless conveying device, said preheating device is disposed ahead of the printing or coating portion in a conveying direction and said heating device is disposed behind the printing or coating device in a conveying direction.

According to a third aspect of the present invention, there is provided a printing or coating device for automobile parts in which an endless conveying device which conveys an automobile component (a work), a preheating device which preheats a work surface conveyed by the endless conveying device by a high frequency heating, a corona discharge treating device in which the work surface conveyed by the conveying device is subjected to a corona discharge treatment before or after preheating, a printing or coating portion which prints or coats the work surface conveyed by the conveying device after subjected to the corona discharge treatment and a heating device which heats and dries ink and paint by the high frequency heating after printing or coating are provided, said preheating device, said corona discharge treating device, said printing or coating portion and said heating device are disposed on a conveying line of said endless conveying device, the preheating device is disposed ahead of the printing or coating portion in a conveying direction and the heating device is disposed behind the printing or coating portion in a conveying direction.

According to a fourth aspect of the present invention, there is provided a printing or coating device for automobile components in which an endless conveying device which conveys an automobile component (a work), a preheating device which preheats a work surface conveyed by the endless conveying device by a high frequency heating, a corona discharge treating device in which the work surface conveyed by the conveying device is subjected to a corona discharge treatment before or after preheating, a printing or coating portion which prints or coats the work surface conveyed by the conveying device after subjected to the corona discharge treatment, a heating device which heats and dries ink and paint by the high frequency heating after printing or coating and an orientation changing mechanism for changing orientation of a work with respect to a printing or coating portion, said preheating device, said corona discharge treating device, said printing or coating portion, said heating device and an orientation changing mechanism are disposed on a conveying line of said endless conveying device, the preheating device is disposed in front of the printing or coating portion in a conveying direction and the heating device is disposed behind the printing or coating portion in a conveying direction.

According to a fifth aspect of the present invention, there is provided a printing or coating device for automobile parts, according to any one of claims 1 to 4, in which two or more printing or coating portions are provided, and the printing or coating portion behind in a conveying direction can apply printing or coating to a work printed or coated by the printing or coating portion ahead in the conveying direction at a previously printed or coated area or a different area.

According to a sixth aspect of the present invention, there is provided a printing or coating device for automobile parts, according to any one of claims 1 to 4, in which two or more heating devices and two or more printing or coating portions are provided, the respective heating devices are disposed behind the respective printing or coating portions in a conveying direction and heating and drying of ink or paint after the printing or coating at the printing or coating portion can be performed by the heating device behind.

According to a seventh aspect of the present invention, there is provided a printing or coating device for automobile parts, according to any one of claims 1 to 4, in which two or more heating devices and two or more printing or coating portions are provided, the respective heating devices are disposed behind the respective printing or coating portions in a conveying direction, heating and drying of ink or paint by high frequency heating after the printing or coating at the printing or coating portion can be performed by the heating device and, after that, printing or coating can be applied to the ink or paint which is heated or dried.

DETAILED DESCRIPTION OF PREFERRED EMBODIMENTS (First Embodiment)

Figure 1:
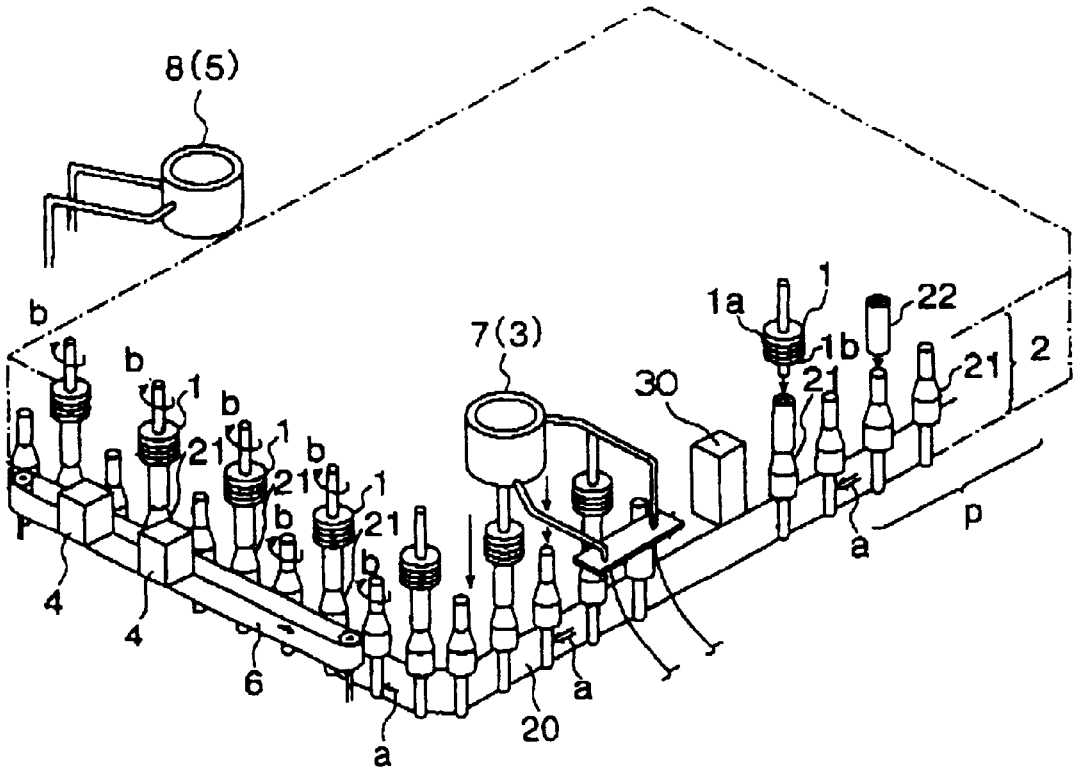
FIG. 1 is a perspective view showing a printing or coating device according to a first embodiment of the present invention.

Now, a printing or coating device according to a first embodiment of the present invention will be explained with reference to FIG. 1. This embodiment relates to a case where a work 1 shown in FIG. 1 is a motor core, and the work 1 comprises a body 1*a* and rotary shafts 1*b* protruded from both axial ends of the body. In the present invention, the work 1 shown in FIG. 1 are pistons of automobile engines shown in FIG. 5A and piston rings shown in FIG. 5B.

A conveying device 2 shown in FIG. 1 serves to convey the work 1. In the conveying device 2, cylindrical supports 21 having a tapered end are spaced apart from each other in a conveying direction and are attached to a chain (conveying member) 20 (rotated in a direction shown by the arrow a) for shifting movement in a direction shown by the arrow b, and metallic or heat-resistive resin support pipes 22 are attached to the tip ends of the alternate supports 21. The support pipes 22 serve to receive the rotary shafts 1*b* of the works 1. The work 1 received by the support pipe 22 is successively passed through a preheating device 3, a printing or coating portion 4 and a heating device 5 while shifting intermittently in the direction a as the conveying member 20 is rotated.

The printing or coating portion 4 is a printing machine for printing a part name, a product name, a company name, a company logo mark, handling or cooking explanation characters, or a decoration pattern or design on an outer peripheral surface of the work 1 conveyed by the conveying device 2 or for coating paint on the work for lubrication, insulation, dressing or anti-corrosion. The printing or coating portion 4 is disposed between the preheating device 3 and the heating device 5 in the conveying device 2. The printing or coating portion 4 can utilize an existing pad printing machine, an existing screen printing machine or a newly improved or developed printing machine. When the work 1 has a curved surface, a curved surface printing machine or a curved surface/flat surface printing machine may be used, and, when the work has a flat surface, a flat surface printing machine or a curved surface/flat surface printing machine may be used. Below the printing or coating portion 4, a belt-shaped orientation changing mechanism 6 is disposed along the conveying device 2. The direction changing mechanism 6 serves to contact with the side surface of the support 21 passed through this mechanism thereby to rotate the support 21 in the direction b. A motor for directly rotating the support 21 or another mechanism may be used as the direction changing mechanism 6.

Figure 2:
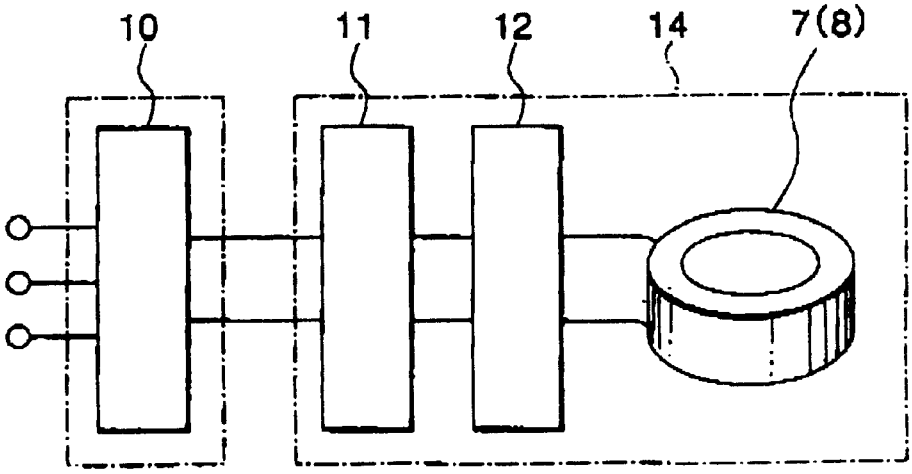
FIG. 2 is a block diagram showing an embodiment of a high frequency heating device used as a preheating device and a heating device.

The preheating device 3 serves to heat the work up to about several tens to 200° C. to improve adhesion of print ink or paint printed or coated on the work 1, and a high frequency heating device is used as the preheating device. As shown in FIG. 2, the high frequency heating device includes a power supply portion 10, an oscillation portion 11, a matching portion 12, and a pre-heating heater portion 78 and the pre-heating heater portion 7 is disposed ahead of the printing or coating portion 4 in a conveying direction of the work 1. The power supply portion 10 is independent from a device body 14 constituted by the oscillation portion 11, matching portion 12 and pre-heating heater portion 7.

The power supply portion 10 is a circuit for converting alternate current of 200 V having three-phase into direct current of 350 V and for outputting the direct current, and current or voltage outputted from the power supply portion 10 can be adjusted to a desired value by a controller (not shown).

The oscillation portion 11 is a circuit for converting the direct current of 350 V outputted from the power supply portion 10 into high frequency of 50 KHz to several MHz, and impedance of the high frequency outputted from the oscillation portion 11 is matched by the matching portion (also referred to as "aligning portion") 12, and the high frequency outputted from the matching portion 12 is inputted to the ring-shaped pre-heating heater portion 7.

The heating device 5 serves to heat the work 1 (after coating) up to about several tends to several hundreds °C. (for example, 250° C.) to dry and cure the print ink or paint printed or coated on the work 1. A high frequency heating device similar to that for the preheating device 3 is used as the heating device 5. The post-heating heater portion 8 of the heating device 5 is disposed behind the printing or coating portion 4 in the conveying direction of the work 1. The heating device 5 may utilize a heater, hot air or laser.

In FIG. 1, a corona discharge treating device 30 by which the surface of the work 1 is subjected to a corona discharge treatment is disposed ahead of the preheating device in the conveying direction. An existing corona discharge treating device can be used as the corona discharge treating device 30. As an example, there is a technique in which, when high voltage (for example, 12 kV) generated from a high frequency high voltage device is applied to two opposed electrodes, discharge is caused between the two electrodes to generate arc at 50 to 60 cycle per second and, when air is blown to the arc, the arc is swollen outwardly of a head and is spread. Expansion and intensity of the arc is determined by applied voltage, air flow and configurations of the electrodes. The generated arc creates corona discharge including ions having high energy. When the corona discharge is blown onto the work 1 to expose the surface of the work 1 to the corona, functional groups having strong polarity such as carbonyl group are formed on the work surface, with the result that wetting property of the surface is enhanced, thereby increasing adhesion strength for ink, adhesive, coating agent or the like greatly.

An operation of the printing or coating device shown in FIG. 1 is as follows.

① At a set area P of the printing or coating device, the work 1 is set on the moving support 21 manually or by a robot.

② The set work 1 is shifted intermittently or continuously toward the pre-heating heater portion 7 as the support 21 is shifted. When the first work 1 is brought to the heater portion 7, the conveying member 20 is temporarily stopped, and the work 1 is stopped immediately below the heater portion 7.

③ The pre-heating heater portion 7 is lowered onto the work 1 to enclose the latter. The power supply portion 10 of the high frequency heating device is turned ON to heat the work 1 with high frequency by the heater portion 7. In this case, the heating temperature is selected to several tens to several hundreds °C. (for example, about 300° C.) in accordance with the property of the paint.

④ When the preheating of the work 1 is finished, the pre-heating heater portion 7 is lifted to be left from the work 1. The conveying member 20 is shifted again to bring the preheated work 1 in front of the printing or coating portion 4 and is stopped there. Meanwhile, shifting, stopping and shifting of the conveying member 20 are repeated, with the result that the shifting, stopping and shifting of the supports 21 and the works 1 set on the supports are repeated. In this way, second work 1 and so on are successively preheated in the pre-heating heater portion 7. Other system or mechanism may be used for separating the pre-heating heater portion 7 froth the work 1. For example, the heater portion 7 may not be lowered and lifted, but the work 1 may be lifted and lowered, or both the work 1 and the heater portion 7 may not be lowered and lifted, but the heater portion 7 may be opened and closed so that the heater portion 7 is separated from the work 1 when the heater portion is opened.

⑤ The work 1 stopped in front of the printing or coating portion 4 is rotated in the direction b by the rotation of the direction changing mechanism 6, with the result that the print ink is printed on the outer peripheral surface of the work 1 or the paint is coated on the outer peripheral surface of the work for lubrication or insulation. The printing or coating to the work 1 is finished, the conveying member 20 is shifted again to shift the support 21 and the printed or coated work 1 toward the post-heating heater portion 8. Similar to the pre-heating heater portion 7, the work 1 is heated with high frequency by the heater portion 8, thereby drying and curing the print ink or paint previously printed or coated on the work 1.

(Second Embodiment)

Figure 3:
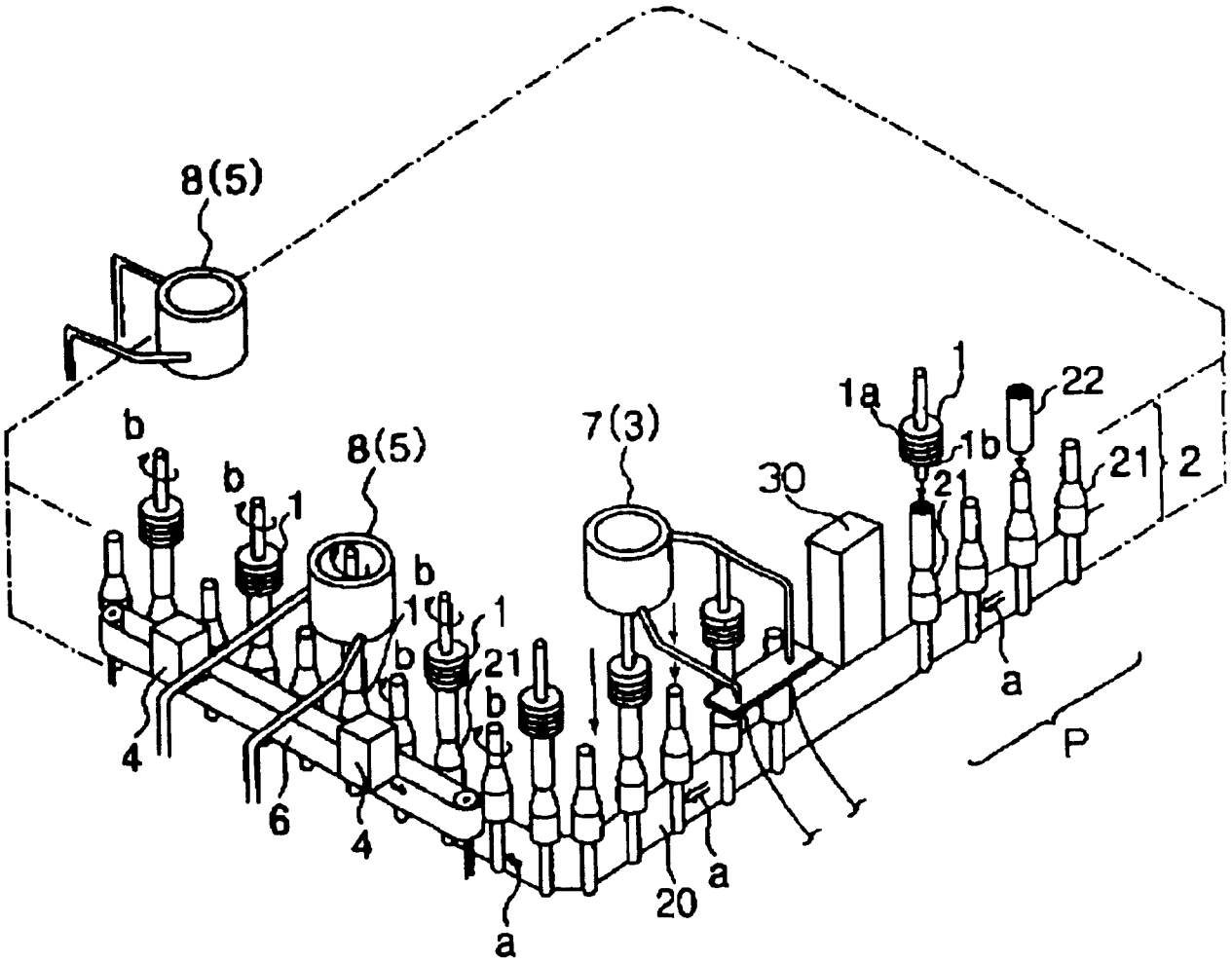
FIG. 3 is a perspective view showing a printing or coating device according to a second embodiment of the present invention.

A printing or coating device according to a second embodiment of the present invention will be explained with reference to FIG. 3. A fundamental construction of the printing or coating device shown in FIG. 3 is the same as that shown in FIG. 1. Differences are that two printing or coating portions 4 are provided, a first post-heating heater portion 8 is disposed between the printing or coating portions 4 and a second post-heating heater portion 8 is disposed behind the second printing or coating portion 4 in the conveying direction. Constructions and functions of the heater portions 8 and the heating device 5 are the same as those shown in FIG. 1.

In the printing or coating device shown in FIG. 3, when the first printing or coating to the work 1 by means of the printing or coating portion 4 ahead in the conveying direction (among two printing or coating portions 4) is completed, the conveying member 20 is shifted to shift the support 21 and work 1 toward the first post-heating heater portion 8 and then is temporarily when the work 1 reaches immediately below the first post-heating heater portion 8. In this case, the work 1 is heated with high frequency by the post-heating heater portion 8, thereby drying and curing the print ink or paint printed or coated by the first printing or coating portion 4. After a predetermined time period is elapsed, the conveying member 20 is shifted again to shift the support 21 and the work 1 toward the printing or coating portion 4 behind the conveying direction and then is then stopped temporarily when the work 1 is conveyed in front of the second printing or coating portion 4, where the second printing or coating is effected by the second printing or coating portion 4. The second printing or coating may be effected on an area where the figure, characters or paint was previously printed or coated or on a different area. When the second printing or coating is finished, the conveying member 20 is shifted again to shift the support 21 and work 1 toward the first post-heating heated portion 8, where the work 1 is heated with high frequency by the second post-heating heater portion 8, thereby drying and curing the print ink or paint printed or coated on the work 1.

(Third Embodiment)

Figure 4:
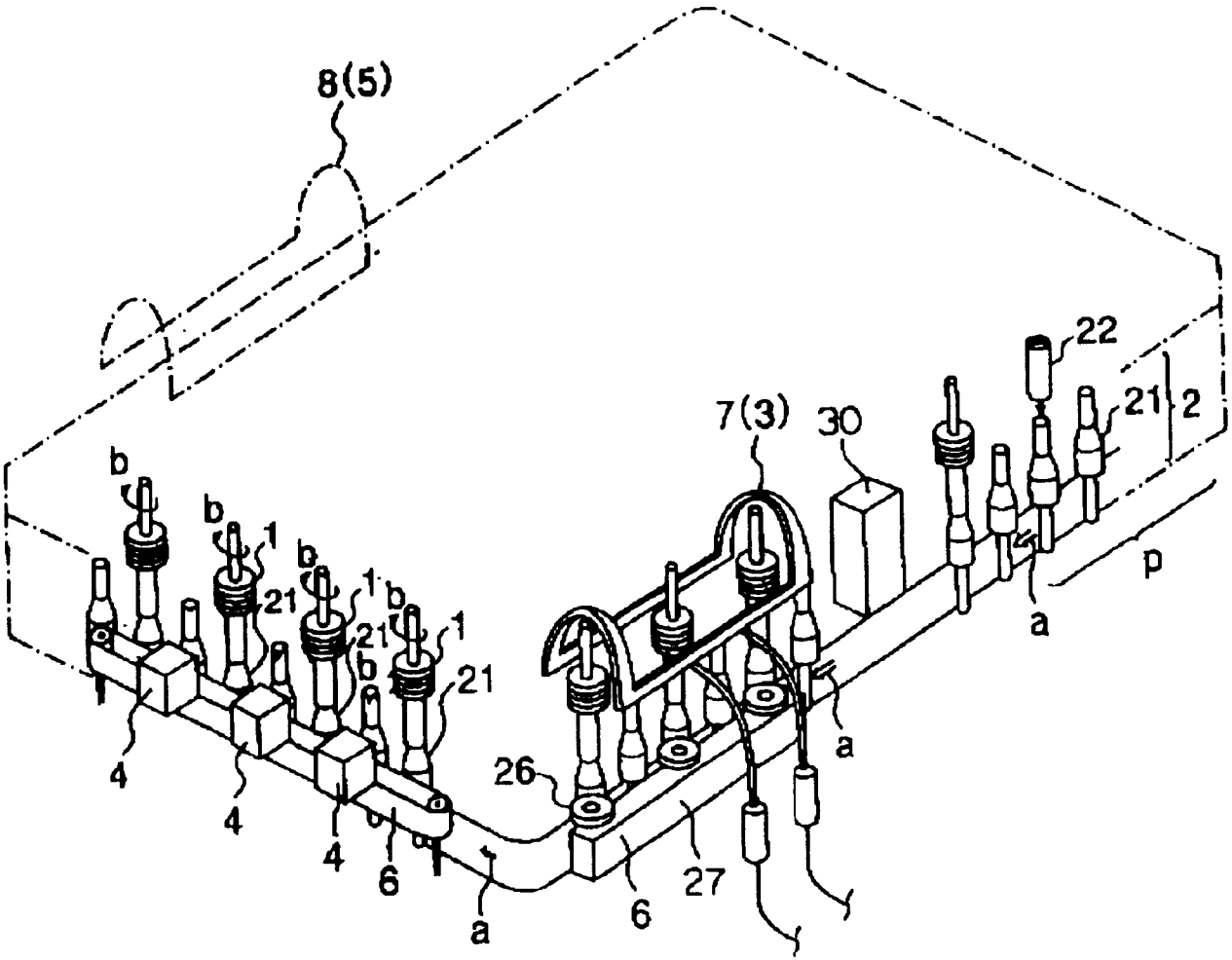
FIG. 4 is a perspective view showing a printing or coating device according to a third embodiment of the present invention.

A printing or coating device according to a third embodiment of the present invention will be explained with reference to FIG. 4. A fundamental construction of the printing or coating device shown in FIG. 4 is the same as that shown in FIG. 1. A difference is that the heater portion 7 of the preheating device 3 and the heater portion 8 of the heating device 8 are formed as tunnels so that a plurality of works 1 can be heated at once. Further, direction changing mechanisms 6 are disposed along the conveying member 20 at side of lower portions of the heater portion 7 of the preheating device 3 and the heater portion 8 of the heating device 8. The direction changing mechanism 6 associated with the pre-heating heater portion 7 is provided with a rotary wheel 26 rotated in a rotation drive portion 27 so that the rotary wheel 26 contacts with the support 21 to rotate the latter, thereby rotating the work 1 supported by the support 21 in a direction shown by the arrow b. The direction changing mechanism 6 associated with the post-heating heater portion 8 is of belt type in which the belt contacts with the support 21 to rotate the latter, thereby rotating the work 1 supported by the support 21 in the direction b. When the work 1 is rotated within the pre-heating heater portion 7, the entire peripheral surface of the work 1 is uniformly pre-heated. When the work 1 is rotated within the post-heating heater portion 8, the entire peripheral surface of the work 1 is uniformly heated and dried. Three printing or coating portions 4 are spaced apart from each other and are disposed between the pre-heating heater portion 7 and the post-heating heater portion 8, so that, while three works 1 are being heated simultaneously by the pre-heating heater portion 7, three previously pre-heated works 1 are simultaneously subjected to printing or coating, and, further, three previously printed works 1 can simultaneously be heated by the post-heating heater portion 8, thereby drying and curing the previously printed or coated print ink or paint. In this case, the three printing or coating portions 4 may apply the printing or coating to the works at the previously printed or coated area by triple or at different areas.

The work 1 supported and conveyed by the support 21 may not be stopped at the pre-heating heater portion 7 and the post-heating heater portion 8 temporarily but may be continuously heated by the heater portions 7, 8 while being continuously conveyed. Although the entire lengths of the heater portions 7, 8 can be selected to desired values other than the above, since the entire device is made bulky if the lengths are too great, it is desirable that the entire lengths be selected necessarily and sufficiently in consideration of request for compactness of the device and working efficiency. Further, the direction changing mechanisms 6 may have configuration or structure different from the illustrated one so long as the mechanisms can rotate the work 1 to uniformly heat the work. The number of the printing or coating portions 4 can be selected to a desired value, other than three. When third and fourth heating devices 5 arc provided between a plurality of printing or coating portions 4, three or more printing can be effected only by conveying one printing line once.

(Fourth Embodiment)

Figure 5A:
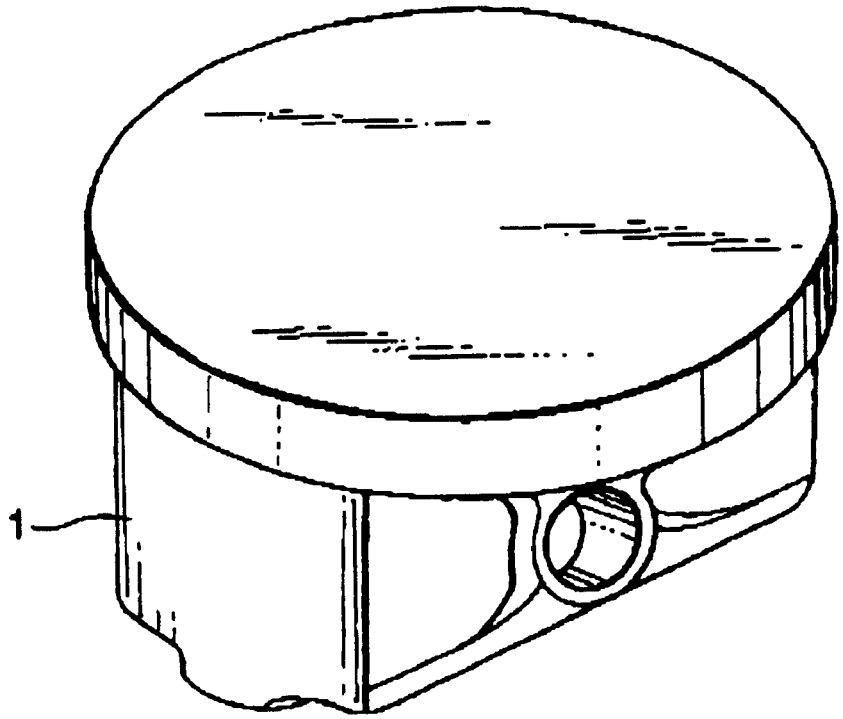
FIGS. 5A and 5B are perspective view showing different examples of a work to be printed or coated by the printing or coating device of the present invention.
Figure 5B:
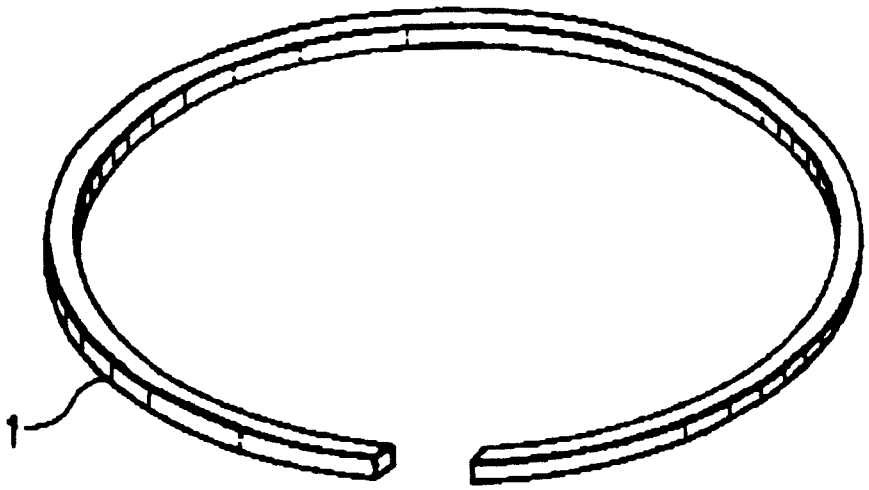

The work 1 printed or coated by the printing or coating method or device is not limited to the illustrated configuration but may have other configuration or structure. For example, a cylindrical shape as shown in FIG. 5A, a ring shape as shown in FIG. 5B, a cylindrical shape as shown in FIG. 8, material of the work is not limited to metal but may be resin, wood, bamboo, leather, stone, glass or the like.

Figure 7:
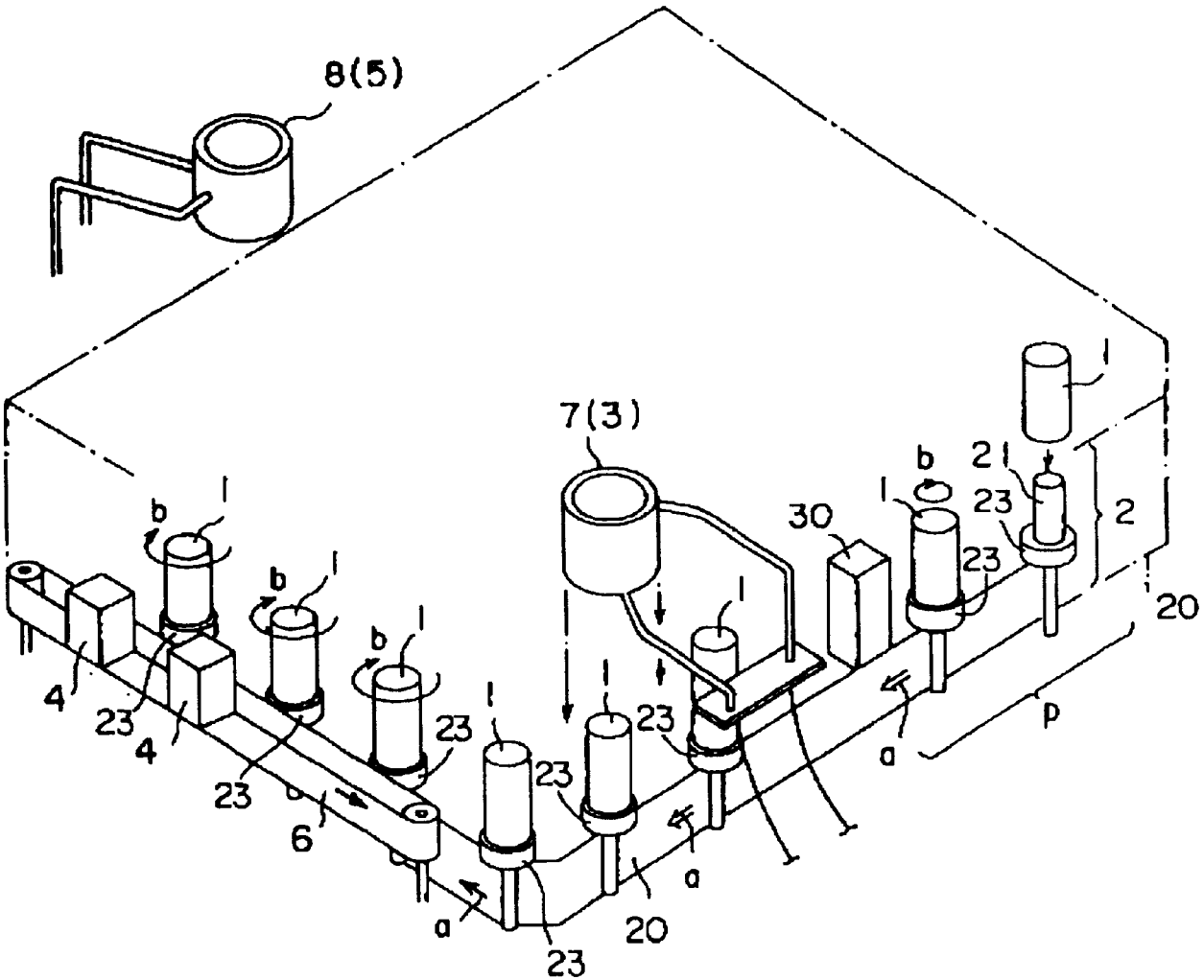
FIG. 7 is a perspective view showing a printing or coating device according to a further embodiment of the present invention.

An embodiment in which the work 1 is a cylinder is shown in FIG. 7. In FIG. 7, cylindrical supports 21 are spaced apart from each other in a conveying direction and are attached to a chain (conveying member) 20 (rotated in a direction shown by the arrow a) for shifting movement in a direction shown by the arrow b, and work 1 are received on the supports 21. As the conveying member 20 is shifted, the work 1 on the supports 21 are shifted intermittently to be successively passed through a corona discharge treating device 30, a preheating device 3, a printing or coating portion 4 and a heating device 5.

Figure 8A:
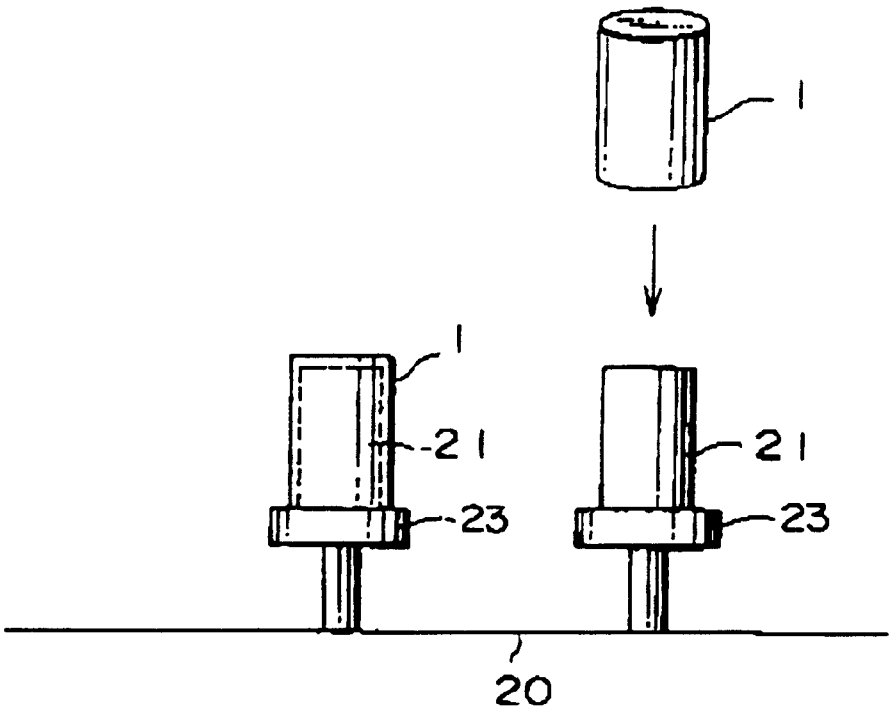
FIG. 8A is an explanatory view for explaining a case where a support is capped by a container in the printing or coating device of the present invention.
Figure 8B:
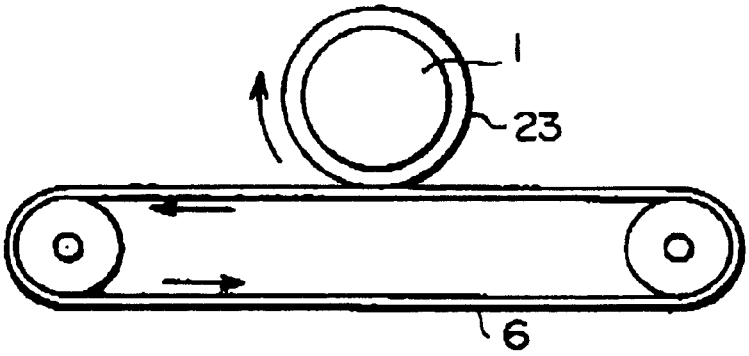
FIG. 8B is a plan view for explaining a case where a support is rotated by a direction changing mechanism.

The support 21 shown in FIG. 7 is a cylinder having a large diameter flange 23 as shown in FIG. 8A, and, as shown in FIG. 8B, a belt-shaped direction changing mechanism 6 is contacted with the flange 23 to rotate the support 21, thereby rotating the container 1. The support may have a configuration other than that shown in FIG. 8A, and the configuration of the support can be changed in accordance with the configuration of the work 1 to be printed or coated. For example, in a case where the work 1 is a cylinder, a support (like a robot hand) in which a plurality of pawls can be opened and closed and the empty container is held from inside when the pawls are opened and the container is released when the pawls are closed can be used. A dish-shaped support or a cylinder having an upper open shallow recess in which the work can be contained and secured may be used.

The conveying device 2 of the present invention may have a configuration other than the illustrated one. For example, an existing free flow conveyor may be used. Since such a conveyor can partially stop and drive only a desired portion, the works 1 can easily be rested on and removed from the conveyor. Incidentally, since the conventional belt conveyor can be stopped and driven entirely, it is difficult to stop it at a correct position. However, the free flow conveyor does not have such inconvenience.

Figure 6:
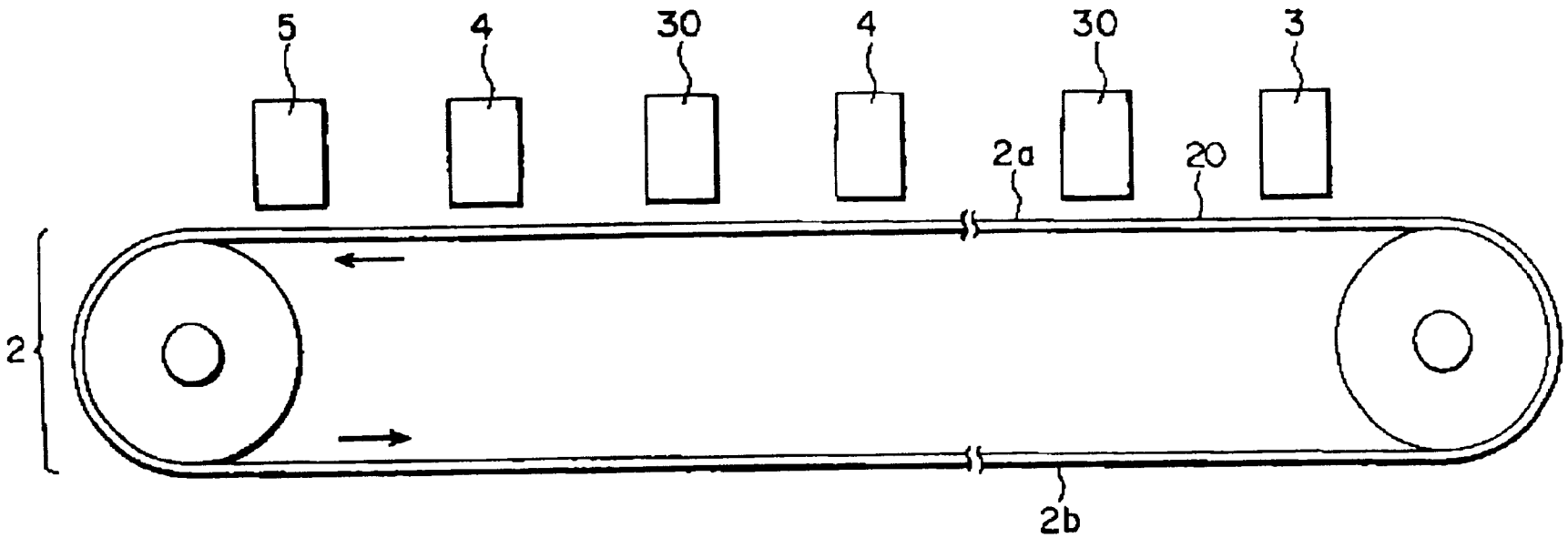
FIG. 6 is a side view showing another example of a printing or coating device of the present invention.

Although the illustrated conveying device 2 is of rectangular endless type, the conveying device 2 may be of straight endless type as shown in FIG. 6. In this case, for example, the supports (not shown) are attached to the conveying member 20 and the works (not shown) set on the supports are pre-heated by the preheating device 3 provided aside an upper run 2*a* of the conveying device 2, and the surfaces of the works arc subjected to a corona discharge treatment by the corona discharge treating device 30, and the work surfaces are printed or coated in the printing or coating portion 4, and the printed or coated surfaces of the works (print ink or paint) are subjected to a corona discharge treatment by the next corona discharge treating device 30, and the work surfaces are subjected to superimposed printing or coating in the next printing or coating portion 4, and the works are heated and dried by the heating device 5, and the heated and dried works are removed from the conveying member 20, and the empty conveying member 20 is shifted as a lower run 2*b* and is returned to the upper run 2*a*.

While the work 1 shown in FIGS. 1 and 2 is set on the conveying member 20 vertically and the work is printed or coated from lateral side, in dependence upon the configuration or structure of the work, the work may be set laterally and the work may be printed or coated from above or from below. The direction changing mechanism 6 shown in FIG. 1 is of belt type in which the works 1 are continuously rotated by rotation of the belt. However, the orientation changing mechanism 6 may have a different configuration. For example, a mechanism for rotating a vertical work 1 by a desired angle such as 90° or 180° horizontally or a mechanism for rotating a vertical work 1 by a desired angle vertically may be used. When the work is rotated by 90° or 180° horizontally, two or more lateral areas on the work can be printed or coated by a single printing machine; whereas, when the work is rotated vertically, two or more upper and lower areas on the work such as upper and lower surfaces can be printed or coated.

In FIGS. 1, 3 and 4, while an example that the corona discharge treating device 30 is disposed in front of the preheating device 3 in the conveying direction was explained, the corona discharge treating device 30 may be located at other position. For example, the corona discharge treating device may be disposed behind the preheating device 3 or the corona discharge treating devices may be provided before and after the preheating device 3. Further, two or more preheating devices 3, printing or coating portions 4, heating devices 5, direction changing mechanisms 6 and corona discharge treating devices 30 may be provided, and disposition thereof may be appropriately determined.

Two or more printing or coating portions 4 may be provided inside and outside of the work 1 or above and below the work, and two or more areas on the work can be printed or coated simultaneously by the two or more printing or coating portions 4.

The print ink and paint are not limited so long as they can easily be adhered to the work 1. For example, as lubricating paint, fluororesin (PTFE), molybdenum disulfide, graphite or mica can be used.

The conveying device 2, corona discharge treating device 30, preheating device 3, printing or coating portion 4 and heating device of the printing or coating device can be incorporated into a working line so that the printing or coating can be effected while working in a single working line. In this case, the filling operation of the contents in the container 1, a closing operation for capping the container or sealing operation can be effected before or after the printing or coating is effected in the printing or coating portion 4.

The printing or coating device according to the present invention may have a cooling device. The cooling device may utilize air cooling, water cooling, and other cooling medium. Further, disposition of the cooling device can be determined in accordance with application. By providing the cooling device, after the work subjected to a heating treatment is cooled, can be removed from the conveying device 2 or sent to a dispensing line or a packing line connected to the conveying device 2 manually or by a robot, thereby improving the working efficiency.

Industrial Availability

The printing or coating device according to the first to seventh aspects provides the following advantages because the preheating device and heating device are provided, and furthermore, they are of the high frequency heating type and provided on the conveying line of the endless conveying device.

① Since the print ink or paint is not fired by the heat of the preheating device and/or the heating device, such devices can be installed near the printing or coating portion, thereby making the printing or coating device compact and reducing the installation space.

② Since the work can be pre-heated, the print ink or paint can easily be adhered to the work.

③ When the preheating is effected immediately before the paint is coated, the temperature of the work is not almost decreased before the paint is coated, with the result that the temperature is not differentiated from work to work, thereby stabilizing the quality of the printing or coating.

④ Since the paint coated on the work can adequately be dried and cured by the compact heating device, the conventional large heating furnace can be omitted, thereby making the printing or coating device further compact.

⑤ Since the preheating device, the printing or coating portion and heating device are disposed on the conveying line, only by setting the work in the conveying device, the subsequent heating, printing or coating, drying and curing of the work are automatically effected, so that automation and speed-up of the coating can be achieved, and productivity is enhanced, and, thus, the production cost can be reduced.

Since the printing or coating device for automobile parts according to the second aspect includes the orientation changing mechanism for changing the orientation of the work, the orientation of the work is changed by the orientation changing mechanism, so that the printing or coating is effected on two or more desired areas of the work. Further, since the entire peripheral surface of the work can be uniformly preheated or can be subjected to the corona discharge treatment uniformly, the printing or coating can be effected on the entire surface uniformly.

The printing or coating device for automobile parts according to the third aspect provides the following advantages because the device is provided with the corona discharge treating device, so that the work surface is subjected to a corona discharge treatment.

① Since the work surface may be subjected to the corona discharge treatment, the adhering ability of the print ink or paint to the work surface is enhanced, thereby achieving the positive adhesion.

② When the work is formed from metal, oil may be adhered to the work surface. In this case, if the printing or coating is effected on the work surface as it is, since the ink or paint may be peeled off, conventionally, it was required that the oil must be removed by an oil removing equipment. However, in the present invention, since the oil is removed by the corona discharge treatment, the oil removing equipment or a cleaning operation can be omitted.

③ When the work is formed from resin, mold releasing agent may be adhered to the work surface. In this case, if the printing or coating is effected on the work surface as it is, since the ink or paint may be peeled off, conventionally, it was required that the mold releasing agent must be removed by a mold releasing agent removing equipment. However, in the present invention, since the mold releasing agent is removed by the corona discharge treatment, the mold releasing agent removing equipment or a cleaning operation can be omitted.

Since the printing or coating device for automobile parts according to the fourth aspect includes the corona discharge treating device and the orientation changing mechanism which are provided on the conveying line of the endless conveying device, the device has the advantages according to the second and third aspect at the same time.

Since the printing or coating device for automobile parts according to the fifth aspect is provided with two or more printing or coating portions, the printing or coating portion behind in a conveying direction can apply printing or coating to a work printed or coated by the printing or coating portion ahead in the conveying direction at a previously printed or coated area by superimposing or a different area.

The printing or coating device for automobile parts according to the sixth aspect is provided with two or more heating devices and two or more printing or coating portions and the heating devices are disposed behind the respective printing or coating portions in a conveying direction so that ink or coating which is printed or coated on a printing or coating portion can be dried by the heating device behind. Thus whenever the printing or coating is effected, the print ink or paint can be dried once, so that the superimposed printing or coating can be effected, and the print ink or paint is positively secured and becomes not easily peeled off. Furthermore after the container is printed or coated, in the case where the printed or coated surface is subjected to the corona discharge treatment and the printing or coating is effected on the printed or coated surface, even when two or more superimposed printing or coating are effected, the inks or paints in the two or more layers are adhered to each other positively and strongly.

The printing or coating device for automobile parts according to the seventh aspect provides the following advantages because the printing or coating portion is of non-spray method.

① The ink or paint is not scattered into the ambient air, and, thus, the working environment is not contaminated by the ink or paint.

② Since the ink or paint is not scattered into the ambient air, excessive or useless ink or paint is not consumed. Incidentally, if the ink or paint is sprayed, since about 80% of the ink or paint sprayed from the spray is scattered into the ambient air and only about 20% of the ink or paint is adhered to the work, a great amount of excessive or useless ink or paint will be consumed.

③ In the past, a duct or a discharging device for discharging ink or paint scattered into the room out of the room, and/or a filter for filtering the discharged ink or paint were provided. However, in the present invention, such elements can be omitted.

The printing or coating device according to the eighth aspect provides the following advantages since the device has either or both of the preheating device and heating device of high frequency heating type, ② Since the work can be pre-heated, the print ink or paint can easily be adhered to the work.

③ When the preheating is effected immediately before the paint is coated, the temperature of the work is not almost decreased before the paint is coated, with the result that the temperature is not differentiated from work to work, thereby stabilizing the quality of the printing or coating.

④ Since the paint coated on the work can adequately be dried and cured by the compact heating device, the conventional large heating furnace can be omitted, thereby making the printing or coating device further compact.

⑤ Only by setting the work in the conveying device, since the subsequent heating, printing or coating, drying and curing of the work are automatically effected, automation and speed-up of the coating can be achieved, and productivity is enhanced, and, thus, the production cost can be reduced.

Since the printing or coating device according to the ninth aspect includes both the corona discharge treating device and the preheating device, the effects according to the seventh and eighth aspects can be obtained.

Since the printing or coating device according to the tenth aspect includes two or more printing or coating portions, the printing or coating can be effected on the work at the area where the print ink or paint was previously printed or coated or at a different area.

Since the printing or coating device according to the eleventh aspect includes not only two or more printing or coating portions but also two or more heating devices and the respective heating devices are disposed behind the respective printing or coating portions in the conveying direction, whenever the printing or coating is effected, the print ink or paint can be dried once, thereby adhering the print ink or paint to the container positively.

Since the printing or coating device according to the twelfth aspect includes the direction changing mechanism for changing the orientation of the work, the orientation of the work is changed by the direction changing mechanism, so that the printing or coating is effected on two or more desired areas of the work. Further, since the entire peripheral surface of the work can be uniformly preheated or can be subjected to the corona discharge treatment uniformly, the printing or coating can be effected on the entire surface uniformly.

What is claimed is:

1. A printing or coating device for automobile parts comprising:

an endless conveying device which conveys an automobile part, a preheating device including a preheater which encloses the automobile part and preheats a work surface on the automobile part conveyed by the endless conveying device by a high frequency heating, a printing or coating portion which prints or coats the preheated work surface conveyed by the conveying device, and a heating device including a heater which encloses the automobile part, and heats and dries ink and paint by the high frequency heating after printing or coating, said preheating device, said printing or coating portion and said heating device are disposed on a conveying line of said endless conveying device, said preheating device is disposed ahead of the printing or coating portion in a conveying direction and said heating device is disposed behind the printing or coating device in the conveying direction.

2. The printing or coating device for automobile parts, according to claim 1, wherein two or more printing or coating portions are provided, and the printing or coating portion behind in the conveying direction applies printing or coating to the work surface printed or coated by the printing or coating portion ahead in the conveying direction at a previously printed or coated area or a different area.

3. The printing or coating device for automobile parts, according to claim 1, wherein two or more heating devices and two or more printing or coating portions are provided, the heating devices are respectively disposed behind the respective printing or coating portions in the conveying direction and heating and drying of ink or paint after the printing or coating at the printing or coating portion is performed by the heating device behind.

4. The printing or coating device for automobile parts, according to claim 1, wherein the printing or coating portion uses a non-spray method.

5. A printing or coating device for automobile parts comprising:

an endless conveying device which conveys an automobile component, a preheating device having a preheater which encloses the automobile part and preheats a work surface on the automobile part conveyed by the endless conveying device by a high frequency heating, a printing or coating portion which prints or coats the preheated work surface conveyed by the conveying device, a heating device including a heater which encloses the automobile part, and heats and dries ink and paint by the high frequency heating after printing or coating, and an orientation changing mechanism for changing orientation of the work surface with respect to a printing or coating portion, said preheating device, said printing or coating portion and said heating device are disposed on a conveying line of said endless conveying device, said preheating device is disposed ahead of the printing or coating portion in a conveying direction and said heating device is disposed behind the printing or coating device in the conveying direction.

6. The printing or coating device for automobile parts, according to claim 5, wherein two or more printing or coating portions are provided, and the printing or coating portion behind in the conveying direction applies printing or coating to the work surface printed or coated by the printing or coating portion ahead in the conveying direction at a previously printed or coated area or a different area.

7. The printing or coating device for automobile parts, according to claim 5, wherein two or more heating devices and two or more printing or coating portions are provided, the heating devices are respectively disposed behind the respective printing or coating portions in the conveying direction and heating and drying of ink or paint after the printing or coating at the printing or coating portion is performed by the heating device behind.

8. The printing or coating device for automobile parts, according to claim 5, wherein the printing or coating portion uses a non-spray method.

9. A printing or coating device for automobile parts comprising:

an endless conveying device which conveys an automobile component, a preheating device including a preheater which encloses the automobile part and preheats a work surface on the automobile part conveyed by the endless conveying device by a high frequency heating, a corona discharge treating device in which the work surface conveyed by the conveying device is subjected to a corona discharge treatment before or after preheating, a printing or coating portion which prints or coats the work surface conveyed by the conveying device after the corona discharge treatment, and a heating device including a heater which encloses the automobile part, and heats and dries ink and paint by the high frequency heating after printing or coating, said preheating device, said corona discharge treating device, said printing or coating portion and said heating device are disposed on a conveying line of said endless conveying device, the preheating device is disposed ahead of the printing or coating portion in a conveying direction and the heating device is disposed behind the printing or coating portion in the conveying direction.

10. The printing or coating device for automobile parts, according to claim 9, wherein two or more printing or coating portions are provided, and the printing or coating portion behind in the conveying direction applies printing or coating to the work surface printed or coated by the printing or coating portion ahead in the conveying direction at a previously printed or coated area or a different area.

11. The printing or coating device for automobile parts, according to claim 9, wherein two or more heating devices and two or more printing or coating portions are provided, the heating devices are respectively disposed behind the respective printing or coating portions in the conveying direction and heating and drying of ink or paint after the printing or coating at the printing or coating portion is performed by the heating device behind.

12. The printing or coating device for automobile parts, according to claim 9, wherein the printing or coating portion uses a non-spray method.

13. A printing or coating device for automobile parts comprising:

an endless conveying device which conveys an automobile component, a preheating device including a preheater which encloses the automobile part and preheats a work surface on the automobile part conveyed by the endless conveying device by a high frequency heating, a corona discharge treating device in which the work surface conveyed by the conveying device is subjected to a corona discharge treatment before or after preheating, a printing or coating portion which prints or coats the work surface conveyed by the conveying device after the corona discharge treatment, a heating device including a heater which encloses the automobile part, and heats and dries ink and paint by the high frequency heating after printing or coating, and an orientation changing mechanism for changing orientation of the work surface with respect to a printing or coating portion, said preheating device, said corona discharge treating device, said printing or coating portion, said heating device and said orientation changing device are disposed on a conveying line of said endless conveying device, the preheating device is disposed in front of the printing or coating portion in a conveying direction and the heating device is disposed behind the printing or coating portion in the conveying direction.

14. The printing or coating device for automobile parts, according to claim 13, wherein two or more printing or coating portions are provided, and the printing or coating portion behind in the conveying direction applies applies printing or coating to the work surface printed or coated by the printing or coating portion ahead in the conveying direction at a previously printed or coated area or a different area.

15. The printing or coating device for automobile parts, according to claim 1, wherein two or more heating devices and two or more printing or coating portions are provided, the heating devices are respectively disposed behind the respective printing or coating portions in the conveying direction and heating and drying of ink or paint after the printing or coating at the printing or coating portion is performed by the heating device behind.

16. The printing or coating device for automobile parts, according to claim 13, wherein the printing or coating portion uses a non-spray method.

* * * * *